US011028573B1

(12) United States Patent
McManus

(10) Patent No.: US 11,028,573 B1
(45) Date of Patent: Jun. 8, 2021

(54) SERRATED BEAM

(71) Applicant: Novel Structures, LLC, Timnath, CO (US)

(72) Inventor: Patrick McManus, Timnath, CO (US)

(73) Assignee: Novel Structures, LLC, Timnath, CO (US)

( * ) Notice: Subject to any disclaimer, the term of this patent is extended or adjusted under 35 U.S.C. 154(b) by 0 days.

(21) Appl. No.: 15/929,292

(22) Filed: Apr. 23, 2020

Related U.S. Application Data

(60) Provisional application No. 62/962,008, filed on Jan. 16, 2020.

(51) Int. Cl.

| | |
|---|---|
| ***E04B 1/21*** | (2006.01) |
| ***E04B 1/58*** | (2006.01) |
| ***E04C 3/294*** | (2006.01) |
| ***E04B 5/29*** | (2006.01) |
| ***E04C 2/04*** | (2006.01) |

(52) U.S. Cl.
CPC ..... *E04B 1/21* (2013.01); *E04B 1/5812* (2013.01); *E04B 5/29* (2013.01); *E04C 2/044* (2013.01); *E04C 3/294* (2013.01)

(58) Field of Classification Search
CPC ..... E04B 1/20; E04B 1/21; E04B 1/61; E04B 1/80; E04B 1/5812; E04B 5/29; E04C 3/294; E04C 3/293; E04C 2003/0452; E04C 2/044
See application file for complete search history.

(56) References Cited

U.S. PATENT DOCUMENTS 1,885,883 A * 11/1932 Young ..... E04B 5/29 52/334
2,246,578 A * 6/1941 De Salardi ..... B21B 1/08 428/593

(Continued)

FOREIGN PATENT DOCUMENTS

AU 2009200214 A1 8/2009
CA 2671647 A1 * 1/2011 ..... E04C 3/09

(Continued)

OTHER PUBLICATIONS

DE29505968U1—German and English Machine Translation (Year: 1995).*

(Continued)

*Primary Examiner* — Ryan D Kwiecinski
*Assistant Examiner* — Matthew J Gitlin
(74) *Attorney, Agent, or Firm* — Husch Blackwell LLP

(57) ABSTRACT

A structural member section comprised of horizontal top and bottom flange elements interconnected by one or more vertical web member. The top flange of the member is serrated such that a series of serrations protrude horizontally in at least one direction from a top of the one or more vertical web member or are cut-out from the flange of a rolled shape. In one embodiment, the serrated top flange and at least a portion of the web member are intended to be encased by a horizontal concrete slab or slab-on-deck assembly. The slab material is capable of encasing all exposed surfaces of and curing around each serration to transfer horizontal shear forces between the serrated top flange and the slab material such that the member and slab behave compositely.

12 Claims, 4 Drawing Sheets

(56) References Cited

U.S. PATENT DOCUMENTS

| | | | | | |
|---|---|---|---|---|---|
| 2,928,512 | A * | 3/1960 | Slater | A47B 57/565 | 403/22 |
| 3,196,763 | A * | 7/1965 | Rushton | E04C 2/427 | 404/21 |
| 3,335,596 | A * | 8/1967 | Noda | B21H 8/00 | 72/194 |
| 3,538,668 | A * | 11/1970 | Anderson | E04C 3/29 | 52/783.18 |
| 3,626,653 | A * | 12/1971 | Amirikan | E04C 3/086 | 52/843 |
| 4,115,971 | A * | 9/1978 | Varga | E04B 5/29 | 52/250 |
| 4,338,381 | A * | 7/1982 | Rogers | E04C 3/04 | 428/573 |
| 5,509,243 | A * | 4/1996 | Bettigole | E01D 19/125 | 52/334 |
| 5,553,437 | A | 9/1996 | Navon | | |
| 5,704,181 | A | 1/1998 | Fisher et al. | | |
| D454,403 | S | 3/2002 | Naccarato et al. | | |
| 6,442,908 | B1 | 9/2002 | Naccarato et al. | | |
| 6,453,973 | B1 * | 9/2002 | Russo | A47B 47/0075 | 160/135 |
| 7,556,454 | B2 * | 7/2009 | Cable | E02D 5/28 | 405/231 |
| 10,151,106 | B2 * | 12/2018 | Niemann | E04B 2/48 | |
| 2003/0188499 | A1 * | 10/2003 | Bronner | E04C 5/02 | 52/378 |
| 2012/0079782 | A1 * | 4/2012 | Kim | E04B 5/29 | 52/220.1 |
| 2014/0325937 | A1 | 11/2014 | Kim | | |

FOREIGN PATENT DOCUMENTS

| | | | | | |
|---|---|---|---|---|---|
| CN | 201867048 | U | 6/2011 | | |
| CN | 102425258 | A | 4/2012 | | |
| CN | 107023114 | B | 3/2019 | | |
| DE | 3836592 | A1 * | 5/1989 | E04B 5/29 | |
| DE | 4113028 | A1 * | 10/1992 | E04B 5/43 | |
| DE | 29505968 | U1 * | 8/1995 | E04B 5/29 | |
| DE | 29505968 | U1 | 9/1995 | | |
| DE | 202006007405 | U1 | 5/2007 | | |
| EP | 0369914 | A1 * | 5/1990 | E04C 3/294 | |
| EP | 1690999 | A2 | 8/2006 | | |
| FR | 726897 | A * | 6/1932 | E04B 1/92 | |
| FR | 910506 | A * | 6/1946 | E04B 5/40 | |
| FR | 2652600 | A2 * | 4/1991 | E04B 5/29 | |
| JP | 2004076379 | A | 3/2004 | | |
| KR | 100796216 | B1 | 1/2008 | | |
| LU | 88443 | A1 * | 7/1995 | E04C 3/086 | |
| WO | 2007141370 | A1 | 12/2007 | | |

OTHER PUBLICATIONS

Jenmar Product Catalog, "Beams", Specifically "Heat Treated Serrated Steel Beams (Waffle)", accessed at https://www.jennmar.com/product-beams on Feb. 14, 2020, 2 pages; actual date of publication unknown.

International Search Report and Written Opinion for PCT/US2021/070047 dated Apr. 9, 2021.

* cited by examiner

SERRATED BEAM

CROSS-REFERENCE TO RELATED APPLICATIONS

This application claims the benefit of U.S. Provisional Patent Application No. 62/962,008, filed Jan. 16, 2020, the entire disclosure of which is hereby incorporated by reference.

BACKGROUND OF THE INVENTION

Field of the Invention

The present invention relates to a structural beam section primarily intended to transfer vertical loads through shear and flexural actions along the length of the member to one or more structural supports.

Description of Related Art

Composite beams and joists are widely used in conventional steel construction. Typically, the beam or joist is located entirely below the composite slab-on-deck assembly. The transfer of horizontal shear forces between the concrete slab and the steel beam or joist is most commonly accomplished through the use of shear connectors, often in the form of headed anchor studs, which are welded to the top of the beam or joist prior to slab placement.

SUMMARY OF THE INVENTION

The present invention utilizes a serrated top flange encased in the concrete slab wherein the headed serrations provide for the transfer of horizontal shear forces between the steel member and the concrete slab. The present invention utilizes a serrated top flange encased in the concrete slab wherein the serrations provide for the transfer of horizontal shear forces between the steel member and the concrete slab. The present invention is directed toward a structural member assembly spanning substantially horizontally between one or more supports wherein the top flange of the cross section is comprised of serrated geometry. In one embodiment, the serrated geometry comprises portions of one or both sides of the top flange of an I-beam being cut out in an alternating pattern. Many cut-out patterns in the flange, as well as configurations of steel member shapes and flange orientations are possible. The top flange of the cross section is intended to be encased by a typically concrete slab such that the serrations in the top flange of the member are encapsulated or encased by the concrete slab and, thereby facilitate horizontal shear transfer between the cross section and the surrounding slab medium thereby creating composite action between the member and surrounding slab. The primary function of this composite beam member is to transfer vertical loads applied along the length of the beam member to one or more supports along the length of the member through shear and flexural forces in the composite assembly.

The member may be comprised of unitary construction or built-up of structural plates, angles, 'T' shaped, 'I' shaped, rectangular or other similar geometric cross sections, though the use of other cross sections are also within the scope of the present invention. The serrations each side of the top flange of the member may be aligned in various configurations, such as alternating portions on the respective sides of the web, or mirror images on either side of the web. Multiple shapes of cut-outs and remaining portions of the flange are provided but may take the form of any shape which facilitates the composite action contemplated herein.

In one embodiment, the member may be self-contained as a beam acting compositely with the surrounding slab. The serrations are comprised of headed geometry whereby the head at the end of each serration has a width measured parallel to the long direction of the member greater than that of the serration shaft, which is disposed between the serration head and the member top flange. While the shape of the head and shaft of the serrations in this embodiment is substantially rectangular, the use of square, circular, elliptical, bulbed, 'L' shaped, 'T' shaped or other geometry for each of the head and shaft, or for head and shaft as a unit, is within the scope of the present invention.

In a second embodiment, additional structural elements may be attached to the top or bottom of the member such that the member acts as the top or bottom chord of a joist or truss assembly, or as the top or bottom flange section of a deep built-up girder. The serrations each side of the top flange of the member may be aligned or staggered. While the shape of the serrations may be substantially rectangular, the use of square, circular, elliptical, bulbed, shaped, 'T' shaped or other geometry is also within the scope of the present invention.

While the member is envisioned to be comprised of steel material and the slab comprised of concrete material, the use of other materials is also within the scope of the present invention. The member in its entirety or individual components of the member may be formed from metal, primarily structural steel, through known fabrication processes such as cutting from plate, casting, built up of welded or bolted shapes, machining, forming from cold bending of plates, extruding, hot rolling, or from other fabrication or manufacturing processes. However, other known materials, such as carbon fiber or other metals, and other manufacturing processes are also within the scope of the present invention.

DESCRIPTION OF THE SEVERAL VIEWS OF THE DRAWINGS

The accompanying drawings form a part of the specification and are to be read in conjunction therewith, in which like reference numerals are employed to indicate like or similar parts in various views.

DETAILED DESCRIPTION OF THE INVENTION

The following detailed description of the present invention references the accompanying drawing figures that illustrate specific embodiments in which the invention can be practiced. The embodiments are intended to describe aspects of the present invention in sufficient detail to enable those skilled in the art to practice the invention. Other embodiments can be utilized and changes can be made without departing from the spirit of the scope of the present invention. The present invention is defined by the appended claims and, therefore, the description is not to be taken in a limiting sense and shall not limit the scope of the equivalents to which such claims are entitled.

Figure 1:
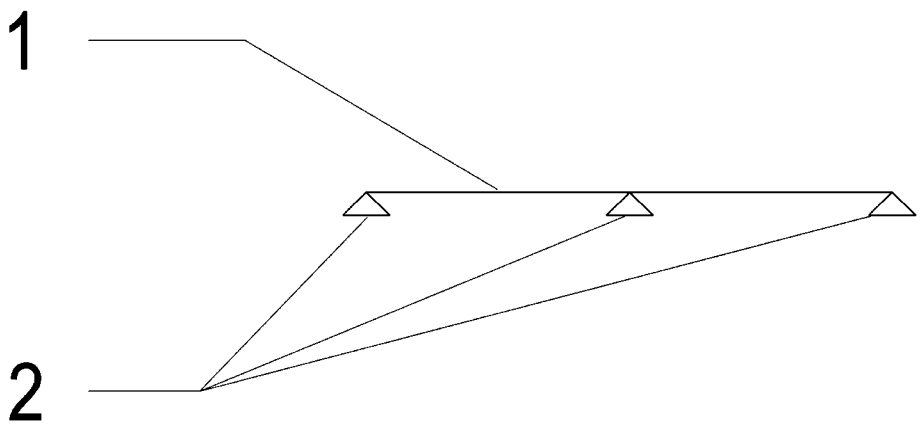
FIG. 1 is a schematic side view of one embodiment of a load carrying member spanning to three structural supports in accordance with the teachings of the present disclosure.

FIG. 1 shows a schematic view of a member 1, or member and slab assembly acting compositely 1, spanning between three structural supports 2. The member 1, or member and slab assembly acting compositely 1, is capable of transferring vertical loads applied along the length of the member to the structural supports 2 through shear and flexural forces in the member 1, or member and slab assembly acting compositely 1.

Figure 2B:
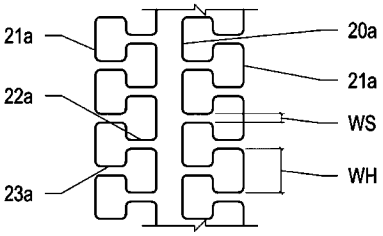
FIG. 2B is a top view of one embodiment of a serrated top flange in accordance with the teachings of the present disclosure and which may be used in the member of FIG. 2A.
Figure 2A:
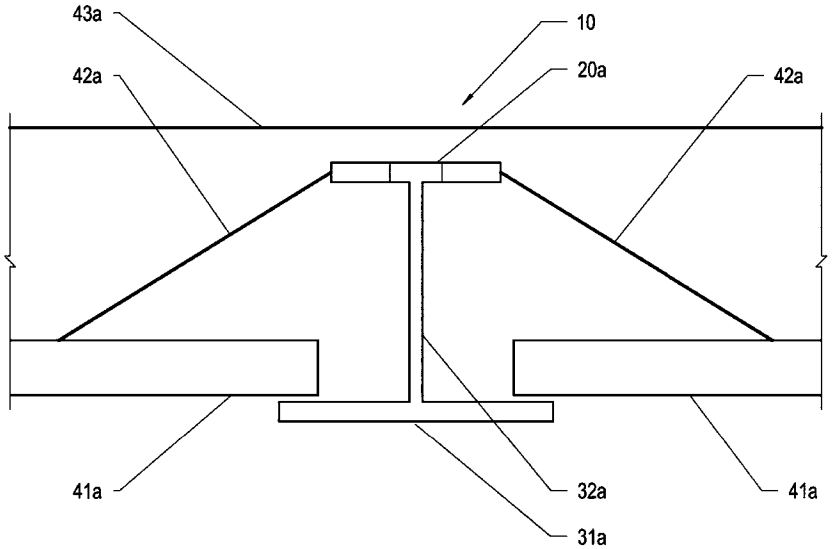
FIG. 2A is a cross sectional view of one embodiment of a member and slab assembly in accordance with the teachings of the present disclosure.

FIGS. 2A and 2B show an embodiment of a member and slab assembly 10 in which the serrated top flange of the member 20*a* is interconnected to the vertical web of the member 32*a*. The vertical web of the member 32*a* is interconnected to the bottom flange of the member 31*a*. The serrated top flange of the member 20*a* and vertical web of the member 32*a* are encased by the concrete slab 43*a*. As best seen in FIG. 2B, the headed serrations 21*a* on one side of serrated top flange 20*a* are staggered along the length of serrated top flange 20*a* in relation to the serrations 21*a* on the opposite side of serrated top flange 20*a*. Each serration 21*a* is comprised of a head 23*a* and a shaft 22*a* whereby the width "WH" of the head 23*a* measured parallel to the long axis of the top flange 20*a* is greater than the width "WS" of the shaft 22*a* measured parallel to the long axis of the top flange 20*a*. The headed serrations 21*a* engage the concrete slab 43*a* such that the serrated top flange 20*a* and the concrete slab 43*a* undergo strains of similar magnitude and direction under applied loading along the length of top flange 20*a* thereby creating composite action. Decking 41*a* spans between the bottom flange of the member 31*a* to support concrete slab 43*a* during placement and participates in transferring superimposed loads imparted to the concrete slab 43*a* to the bottom flange of the member 31*a*. Intermittent struts 42*a* brace the serrated top flange of the member 20*a* to the decking 41*a* to resist horizontal movement perpendicular to the long direction of the serrated top flange 20*a* thereby mitigating lateral torsional buckling of the member during placement of the concrete slab 43*a*.

Generally throughout, concrete slab 43*a* the use of concrete may be another structural medium which can be poured or installed in more of a liquid state, then cured or solidified into a more rigid or solid state. Concrete is a good example, but it could be flowable grout, epoxy mixtures, or other similar structural medium.

Figure 3B:
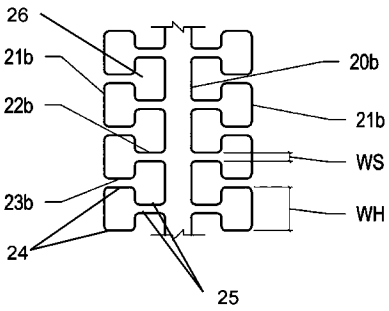
FIG. 3B is a top view of one embodiment of a serrated top flange in accordance with the teachings of the present disclosure and which is included in the member of FIG. 3A.
Figure 3A:
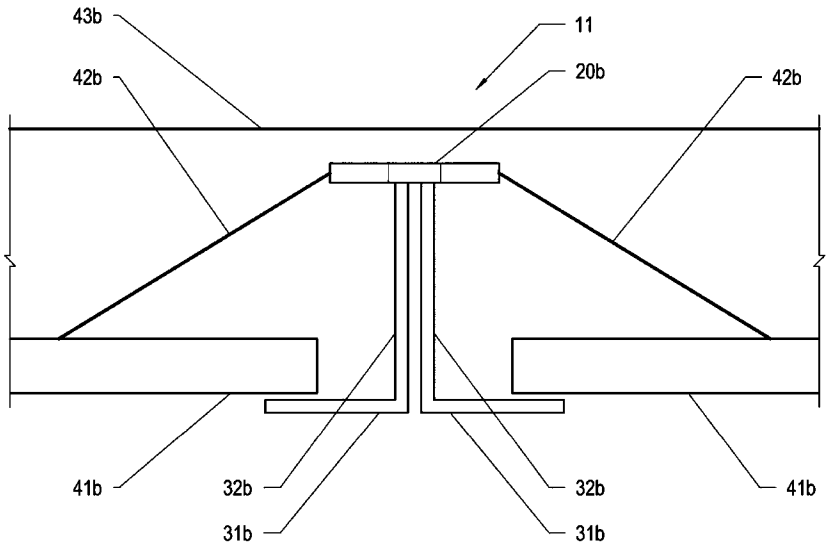
FIG. 3A is a cross sectional view of one embodiment of a member and slab assembly in accordance with the teachings of the present disclosure.

FIGS. 3A and 3B show an embodiment of a member and slab assembly 11 in which the serrated top flange of the member 20*b* is interconnected to two vertical webs of the member 32*b*. Each vertical web of the member 32*b* is interconnected to a bottom flange of the member 31*b* such that each web and bottom flange assembly together comprise an 'L' shape. The serrated top flange of the member 20*b* and vertical webs of the member 32*b* are encased by the concrete slab 43*b*. The headed serrations 21*b* on one side of the serrated top flange 20*b* are substantially aligned with the serrations 21*b* on the opposite side of serrated top flange 20*b*. Each serration 21*b* is comprised of a head 23*b* and a shaft 22*b* whereby the width of the head 23*b* measured parallel to the long axis of the top flange 20*b* is greater than the width of the shaft 22*b* measured parallel to the long axis of the top flange 20*b*. As further shown in FIG. 3B, in one embodiment, head 23*b* of serration 21*b* may include sides 24 that are substantially linear, and shaft 22*b* of serration 21*b* may also include sides 25 that are substantially linear. As further shown in FIG. 3B, the plurality of serrations 21*b* define a plurality of voids 26 wherein it is shown that the shape of the void defined by the serrations 21*b* is a substantial mirror image of the shape of the serrations 21*b*. The headed serrations 21*b* engage the concrete slab 43*b* such that the serrated top flange 20*b* and the concrete slab 43*b* undergo strains of similar magnitude and direction under applied loading along the length of top flange 20*b* thereby creating composite action. Decking 41*b* spans between the bottom flanges of the member 31*b* to support concrete slab 43*b* during placement and participates in transferring superimposed loads imparted to the concrete slab 43*b* to the bottom flanges of the member 31*b*. Intermittent struts 42*b* brace the serrated top flange of the member 20*b* to the decking 41*b* to resist horizontal movement perpendicular to the long direction of the serrated top flange 20*b* thereby mitigating lateral torsional buckling of the member during placement of the concrete slab 43*b*.

Figure 4A:
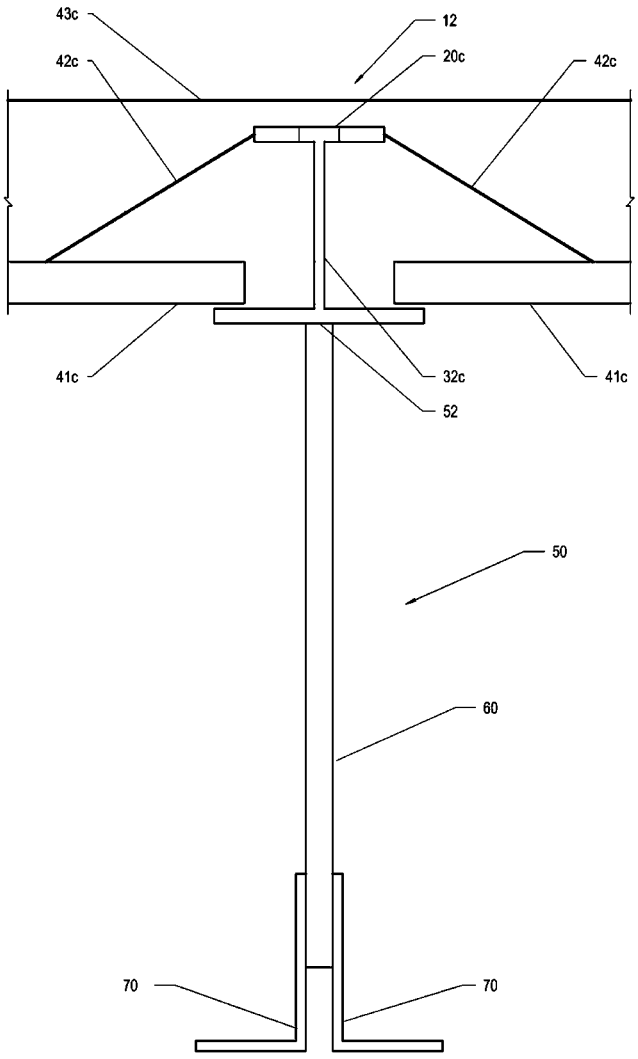
FIG. 4A is a cross sectional view of one embodiment of a member and slab assembly wherein the bottom chord of the truss, or bottom flange of the built-up member is comprised of two 'L' shaped sections in accordance with the teachings of the present disclosure.

FIG. 4A shows an embodiment of a truss, joist or built-up girder assembly 50 in which the top chord of the truss or joist, or top flange of the built-up girder, is comprised a member and slab assembly 12. Member slab assembly 12 is interconnected to truss or joist web members 60 in the case of a truss or joist assembly 50, or a web plate 60 in the case of a built-up girder assembly 50. In one embodiment, a serrated flange 20*c* is connected to web 32*c*, which may be a WT section or a built-up member. Similar to other embodiments, decking 41*c* may be supported by a flange member 52 that can either carry compression or tension bending force depending upon where the neutral axis of the composite shape is located. In most embodiments, flange member 52 will typically carry compression force and decking 41*c* laterally braces flange 52 to prevent buckling. In addition, intermittent struts 42*c* may also be utilized in the member slab assembly. In some embodiments, the intermittent struts not only provide stability when pouring the concrete, but also are encased by the slab and may contribute to the composite performance of the member slab assembly 12.

Figure 4B:
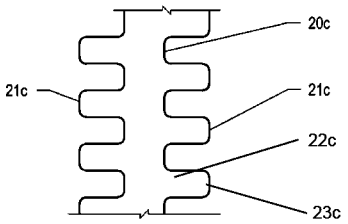
FIG. 4B is a top view of one embodiment of a serrated top flange in accordance with the present disclosure and which may be included in the members of FIG. 4A.

As further shown in FIG. 4A, the bottom chord of the truss or joist assembly 50, or bottom flange of a built-up girder assembly 50, is comprised two 'L' shaped sections 70. The 'L' shaped sections 70 are interconnected to the truss or joist web members 60 in the case of a truss or joist assembly 50, or a web plate 60 in the case of a built-up girder assembly 50. In one embodiment, the web plate 60 of a built-up girder may have a series of openings, such as a castellated beam. FIG. 4B shows an embodiment of member and slab assembly 12 in which the serrated top flange of the member 20*c* is interconnected to the vertical web of the member 32*c*. The vertical web of the member 32*c* is interconnected to a bottom flange of the member 52. The serrated top flange of the member 20*c* and vertical webs of the member 32*c* are encased by the concrete slab 43*c*. The serrations 21*c* on one side of the serrated top flange 20*c* are staggered along the length of serrated top flange 20*c*. The substantially rectangular serrations 21*c* engage the concrete slab 43*c* such that the serrated top flange 20*c* and the concrete slab 43*c* undergo strains of similar magnitude and direction under applied loading along the length of top flange 20*c* thereby creating composite action. In this embodiment, the substantially rectangular serrations 21*c* include a shaft 22*c* and a head 23*c* having the same width to define the substantially rectangular shape. Decking 41*c* spans between the bottom flanges of the member 31*c* to support concrete slab 43*c* during placement and participates in transferring superimposed loads imparted to the concrete slab 43*c* to the bottom flanges of the member 52. Intermittent struts 42*c* brace the serrated top flange of the member 20*c* to the decking 41*c* to resist horizontal movement perpendicular to the long direction of the serrated top flange 20*c* thereby mitigating lateral torsional buckling of the member during placement of the concrete slab 43*c*.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

I claim:

1. A structural member spanning one or more structural supports, the structural member comprising:

a serrated horizontal top flange member operably coupled to one or more vertical web member, said serrated horizontal top flange member comprising a plurality of serrations arranged in a spaced apart manner on the serrated horizontal top flange member and defining a plurality of voids between adjacent serrations of the plurality of serrations;

wherein each of the plurality of serrations comprises a head portion, and a shaft portion and wherein said serrations are co-planar with said horizontal top flange member, and said plurality of voids each have a shape that is substantially a mirror image of a shape of each of said plurality of serrations;

wherein a width of the head portion measured in a direction parallel to a long axis of said structural member is greater than a width of the shaft portion measured in the direction parallel to the long axis of said structural member, and wherein each of said shaft portions have a first substantially linear side and a second substantially linear side, and each of said head portions have a first substantially linear side and a second substantially linear side.

2. The structural member of claim 1 further comprising:

each of said one or more vertical web member operably coupled to one or more horizontal bottom flange members;

the plurality of serrations of said serrated horizontal top flange member protruding horizontally from said serrated horizontal top flange member in a direction substantially perpendicular to the long axis of the structural member;

said plurality of voids defined by said plurality of serrations on said serrated horizontal top flange member arranged to allow encasement by a structural medium capable of surrounding each exposed surface of each of said plurality of serrations;

said width of said shaft portion of said plurality of serrations being able to transfer at least a portion of a load applied along the structural member to said one or more structural supports via said structural member.

3. The member of claim 2 wherein a thickness of said serrated horizontal top flange member and a thickness of said horizontal bottom flange member are equal.

4. The member of claim 1 wherein said plurality of serrations comprise a first plurality of serrations on one side of said serrated horizontal top flange member that are staggered with respect to a second plurality of serrations on the opposite side of said serrated horizontal top flange member.

5. The member of claim 1 wherein said head and said shaft individually or as a unit are of a geometry including straight, sloped, tapered, stepped, rectangular, 'T' shaped, 'L' shaped, 'Y' shaped, 'S' shaped, or inclusive of one or more perforations.

6. A structural load bearing assembly comprising:

a structural member having a serrated horizontal top flange, said serrated horizontal top flange member comprising a plurality of serrations arranged in a spaced apart manner on the serrated horizontal top flange member and defining a plurality of voids between adjacent serrations of the plurality of serrations;

wherein each of the plurality of serrations comprises a head portion and a shaft portion, and wherein said shaft portion has a first substantially linear side and a second substantially linear side, and said head portion has a first substantially linear side and a second substantially linear side;

wherein a width of the head portion measured in a direction parallel to a long axis of said structural member between the first substantially linear side and the second substantially linear side of the head portion is greater than a width of the shaft portion measured in the direction parallel to the long axis of said structural member between the first substantially linear side and the second substantially linear side of the shaft portion, and wherein said serrations are co-planar with said horizontal top flange member; and a structural medium defining a floor slab disposed above said structural member, wherein said structural medium encases the plurality of serrations of the serrated horizontal top flange to provide a horizontal shear transfer between the floor slab through the serrations to the serrated horizontal top flange to sufficiently develop a composite action between the structural member and slab.

7. The structural load bearing assembly of claim 6, wherein said structural member is braced against horizontal translation by a bracing member, wherein the bracing member is selected from a group consisting of metal decking, or wood decking.

8. The structural load bearing assembly of claim 6 wherein the floor slab is a concrete slab, and said horizontal serrated top flange member and a portion of at least one vertical web member of said structural member is encased within said concrete slab.

9. The structural load bearing assembly of claim 6, further comprising a continuous strut or a plurality of intermittent struts operably connected to at least one side of said serrated horizontal top flange.

10. The structural load bearing assembly of claim 6 wherein said plurality of voids each have a shape that is substantially a mirror image of a shape of each of said plurality of serrations.

11. A structural load bearing assembly comprising:

a structural member having a serrated horizontal top flange, said serrated horizontal top flange member comprising a plurality of serrations arranged in a spaced apart manner on the serrated horizontal top flange member and defining a plurality of voids between adjacent serrations of the plurality of serrations;

wherein each of the plurality of serrations comprises a head portion and a shaft portion, and wherein said plurality of voids each have a shape that is substantially a mirror image of a shape of each of said plurality of serrations;

wherein a width of the head portion measured in a direction parallel to a long axis of said structural member is greater than a width of the shaft portion measured in the direction parallel to the long axis of said structural member; and a structural medium defining a floor slab disposed above said structural member, wherein said structural medium encases the plurality of serrations of the serrated horizontal top flange to provide a horizontal shear transfer between the floor slab through the serrations to the serrated horizontal top flange to sufficiently develop a composite action between the structural member and slab.

12. The structural load bearing assembly of claim 11 wherein said serrations are co-planar with said horizontal top flange member.

* * * * *